US007055537B2

(12) United States Patent
Elick et al.

(10) Patent No.: US 7,055,537 B2
(45) Date of Patent: Jun. 6, 2006

(54) BULLET ENDED WASH TUBE FOR DISHWASHER

(75) Inventors: Robert A. Elick, Jackson, TN (US); John Trevor Morrison, Cedar Grove, TN (US)

(73) Assignee: Maytag Corporation, Newton, IA (US)

( * ) Notice: Subject to any disclaimer, the term of this patent is extended or adjusted under 35 U.S.C. 154(b) by 575 days.

(21) Appl. No.: 10/184,405

(22) Filed: Jun. 27, 2002

(65) Prior Publication Data

US 2004/0000331 A1 Jan. 1, 2004

(51) Int. Cl.
*B08B 3/00* (2006.01)

(52) U.S. Cl. ..... 134/180; 134/183

(58) Field of Classification Search ..... 134/172–180, 134/182–183, 200

See application file for complete search history.

(56) References Cited

U.S. PATENT DOCUMENTS

| | | | | |
|---|---|---|---|---|
| 3,415,259 | A | 12/1968 | Noren et al. | |
| 4,064,887 | A | 12/1977 | Geiger et al. | |
| 4,179,307 | A * | 12/1979 | Cau et al. | 134/58 D |
| 4,257,559 | A | 3/1981 | Noren | |
| 4,657,188 | A | 4/1987 | Crane et al. | |
| 4,735,222 | A | 4/1988 | Crane et al. | |
| 5,823,211 | A | 10/1998 | Wilhelmstatter et al. | |
| 5,927,616 | A | 7/1999 | Grise et al. | |
| 6,431,188 | B1 * | 8/2002 | Laszczewski et al. | 134/56 D |

FOREIGN PATENT DOCUMENTS

| | | |
|---|---|---|
| DE | 019705548 A1 | 8/1998 |
| EP | 0 401 767 A1 | 12/1990 |
| EP | 0 829 221 A2 | 3/1998 |
| EP | 0 864 291 A1 | 9/1998 |
| EP | 0 872 208 A1 | 10/1998 |

* cited by examiner

*Primary Examiner*—Joseph L. Perrin
(74) *Attorney, Agent, or Firm*—McKee, Voorhees & Sease, P.L.C.

(57) ABSTRACT

An improved wash tube is provided for a dishwasher. The wash tube is mounted on the upper rack and has a first end adapted to be releasably docked with the water manifold in the back of the dishwashing chamber as the rack is moved between the extended loading position and the retracted wash position. The inner end of the wash tube includes a curved cap which increases the docking tolerance and which presents a substantially downwardly oriented water inlet to the wash tube. The cap creates water stagnation adjacent the inlet such that the water velocity is substantially reduced and the pressure increased. The second end of the wash tube is connected to the spray arm which rotates as water is ejected from the spray arm nozzles at increased pressure. The cap allows the wash tube to fully dock into the manifold without obstructing the water inlet.

18 Claims, 4 Drawing Sheets

BULLET ENDED WASH TUBE FOR DISHWASHER

BACKGROUND OF THE INVENTION

Dishwashers typically have upper and lower racks for holding objects to be washed. Rotatable spray arms are provided in the chamber for spraying water onto the objects for cleaning. Often times, one of the spray arms is positioned between the upper and lower racks, with a wash tube extending between the spray arm and the water manifold in the back wall of the washing chamber. The wash tube is connected to the upper rack and is adapted to dock to and undock from the water manifold, such that the wash tube and spray arm move with the rack between the extended loading position substantially outside of the wash chamber and the retracted wash position within the wash chamber.

The docking of the wash tube with the water manifold presents several problems in the prior art. First, the wash tube must be aligned with the manifold opening to allow for proper docking. While a tapered end on the wash tube has somewhat reduced the docking alignment problem, the flat or planer end of the wash tube still creates alignment problems.

Secondly, the flat end of the wash tube defines an opening or inlet which is in a plane parallel to the water flow in the water manifold. Thus, the flow of water from the manifold into the wash tube is not efficient. Also, the water in the wash tube is not at optimal pressure.

Accordingly, a primary objective of the present invention is the provision of an improved wash tube for a dishwasher which overcomes the problems of the prior art.

Another objective of the present invention is the provision of a bullet ended wash tube to provide improved coupling of the wash tube with the water manifold in the rear of the dishwasher.

A further objective of the present invention is the provision of a wash tube having a first end which couples with the manifold, wherein the first end includes a cup for directing water from the manifold into the wash tube.

Still another objective of the present invention is the provision of a wash tube having a first end with a downwardly oriented inlet.

Another objective of the present invention is the provision of an improved dishwasher wash tube which increases the water pressure from the water manifold to the spray arm.

Still another objective of the present invention is the provision of an improved dishwasher wash tube which bottoms out on the rear inner surface of the water manifold without restricting the flow of water into the wash tube.

These and other objectives will be apparent from the following description of the invention.

SUMMARY OF THE INVENTION

An improved wash tube is provided for a dishwasher having a wash chamber and a rack movable between an extended loading position substantially out of the wash chamber and a retracted cleaning position within the wash chamber. The dishwasher has a water manifold in a rear wall of the wash chamber. The wash tube is mounted to the rack, and extends between the water manifold and a rotatable spray arm for spraying water onto objects to be cleaned. The tube has an elongated body with a first end adapted to releasably dock with the water manifold, and a second end adapted to be mounted to the spray arm. The first end has a bullet-shape so as to provide increased tolerances for the docking or coupling of the wash tube with the water manifold. The bullet end includes a downwardly oriented opening so as to define a cup which directs water from the manifold into the wash tube at a reduced velocity and increased pressure. The bullet ended wash tube may engage the rear wall of the water manifold without obstructing the inlet opening which is oriented in a plane perpendicular to the flow of water through the manifold.

DETAILED DESCRIPTION OF THE INVENTION

Figure 1:
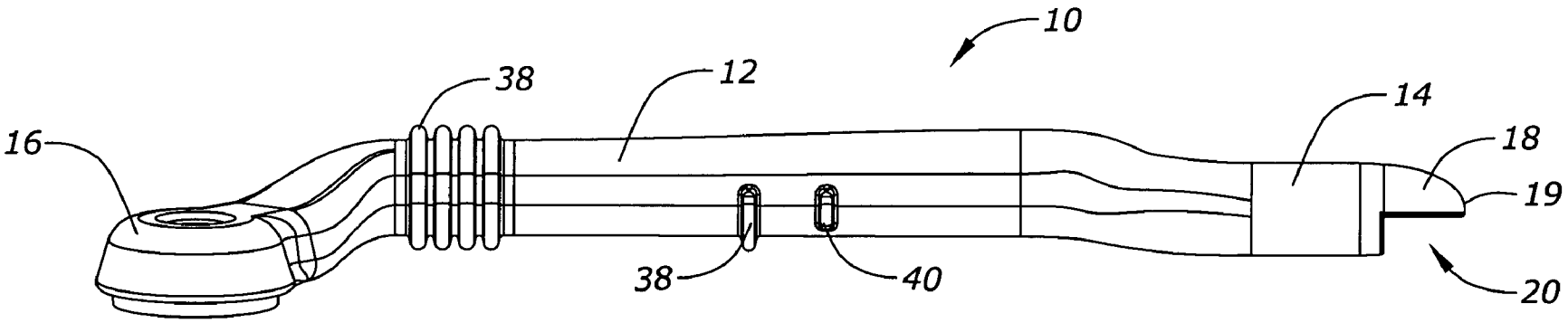
FIG. 1 is a side elevation view of the wash tube of the present invention.

The improved wash tube of the present invention is generally designated in the drawings by the reference numeral 10. The wash tube 10 has a body 12 with opposite first and second ends 14, 16, respectively.

The first end 14 of the wash tube 10 terminates in a curved, bullet shaped cap 18, as best seen in FIG. 1. The cap 18 extends from the upper ½ of the tube end 14, with a semi-circular connection to the tube end 14 and tapering to a narrowed, rounded nose 19. The cap has a horizontally disposed, U-shaped lower perimeter edge 21, seen in FIG. 2, defining a water inlet 20, which is oriented in a horizontal plane, as best seen in FIG. 1. The first end 14 is adapted to be coupled to a docking station 22 in a water manifold 24 located in the rear wall of the washing chamber of the dishwasher. The cap 18 captures water flowing upwardly through the manifold 24 and redirects the flow of water approximately 90° from the vertically upward flow through the water manifold 24 to a horizontally forward flow into the body 12 of the wash tube 10 for delivery to the spray arm 30. The velocity of the water flow through the manifold is thus decreased to substantially zero when captured by the cap 18 of the wash tube 10, which in turn increases the water pressure through the wash tube 10. Thus, the water pressure through the spray on nozzles 32 is increased for enhanced cleaning for the objects in the racks. The curved shape of the cap 18 increases the docking tolerance between the wash tube 10 and the opening in the docking station 22.

Figure 4:
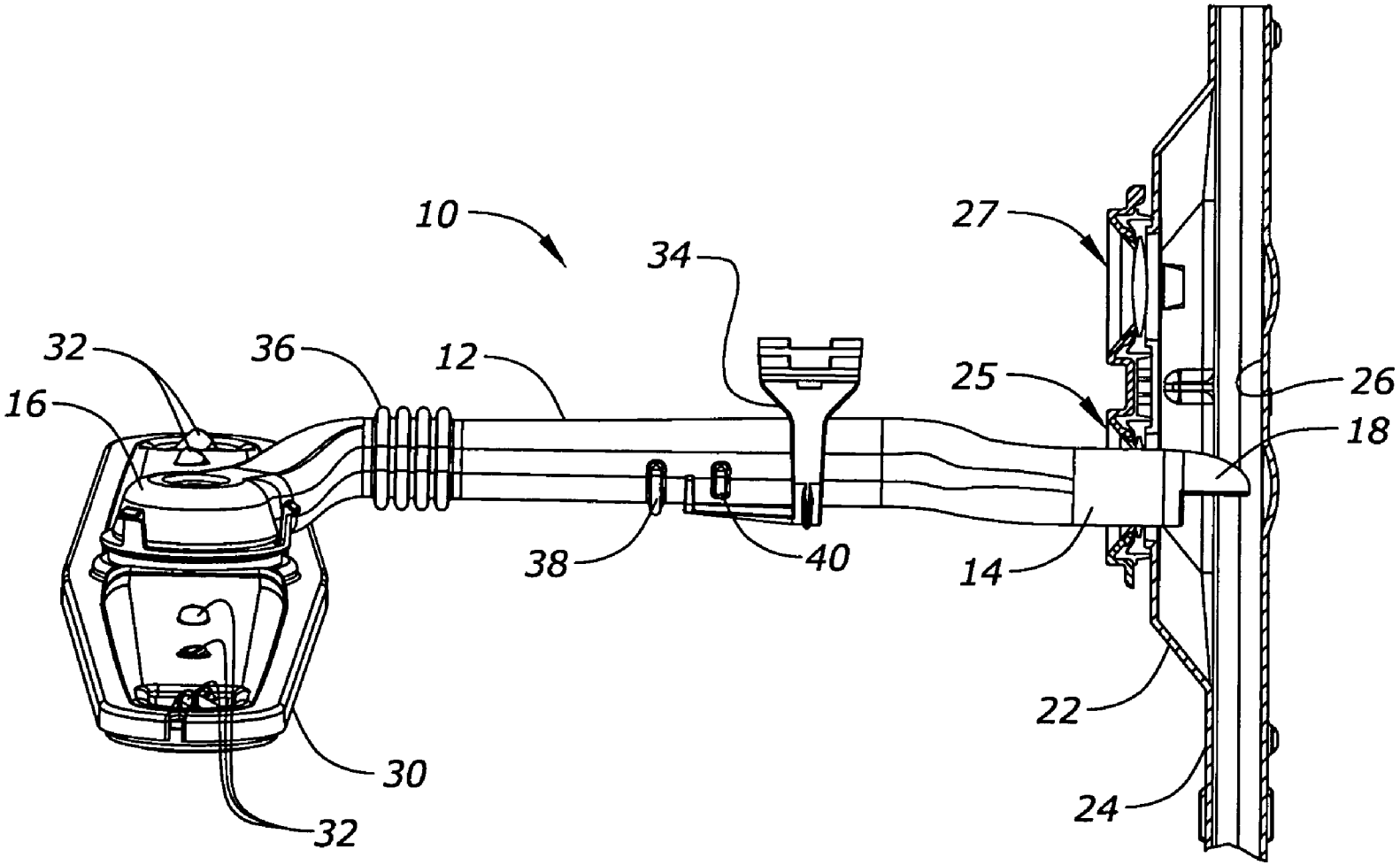
FIG. 4 is a side elevation view of the wash tube coupled to the water manifold.

As seen in FIG. 4, the first end 14 extends through the docking station 22 such that the cap 18 is in close proximity, or engages, the rear wall 26 of the manifold 24. When the wash tube 10 is docked with the manifold 24, the water inlet 20 extends perpendicular to the flow of water upwardly through the manifold 24. Thus, the cap 18 may engage the inner surface 26 of the manifold 24 without restricting the flow of water into the wash tube 10.

Figure 3:
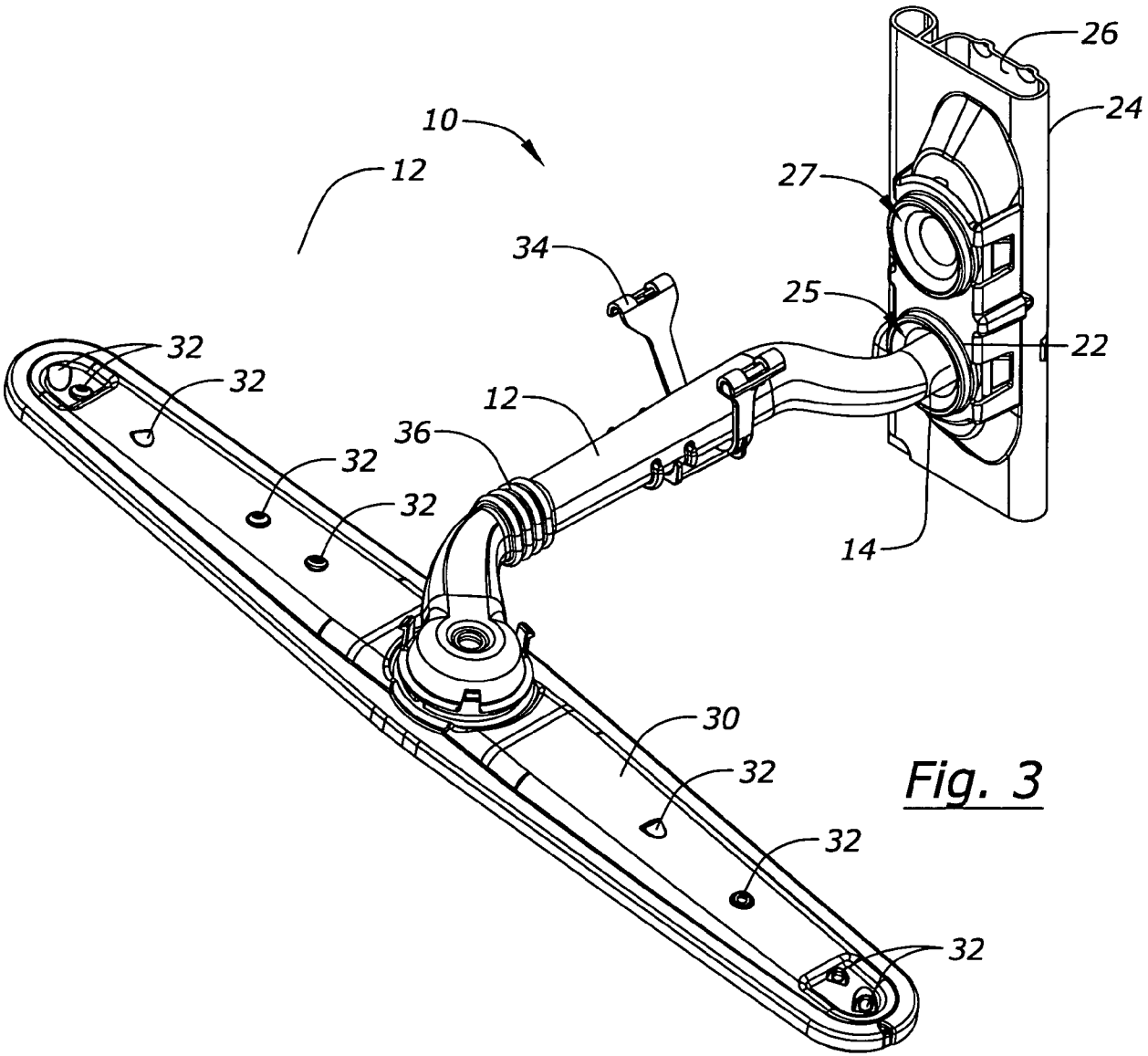
FIG. 3 is a perspective view showing the wash tube docked with a dishwasher fluid manifold and with a spray arm attached to the wash tube.

In FIGS. 3 and 4, the water manifold 24 is shown as having a lower opening 25 and an upper opening 27. Such a dual opening manifold is provided in dishwashers wherein the rack is movable upwardly and downwardly to accommodate different sized objects to be washed. If the dishwasher has a fixed upper rack, only a single opening need be provided in the manifold 24 for docking with the wash tube 10.

Figure 2:
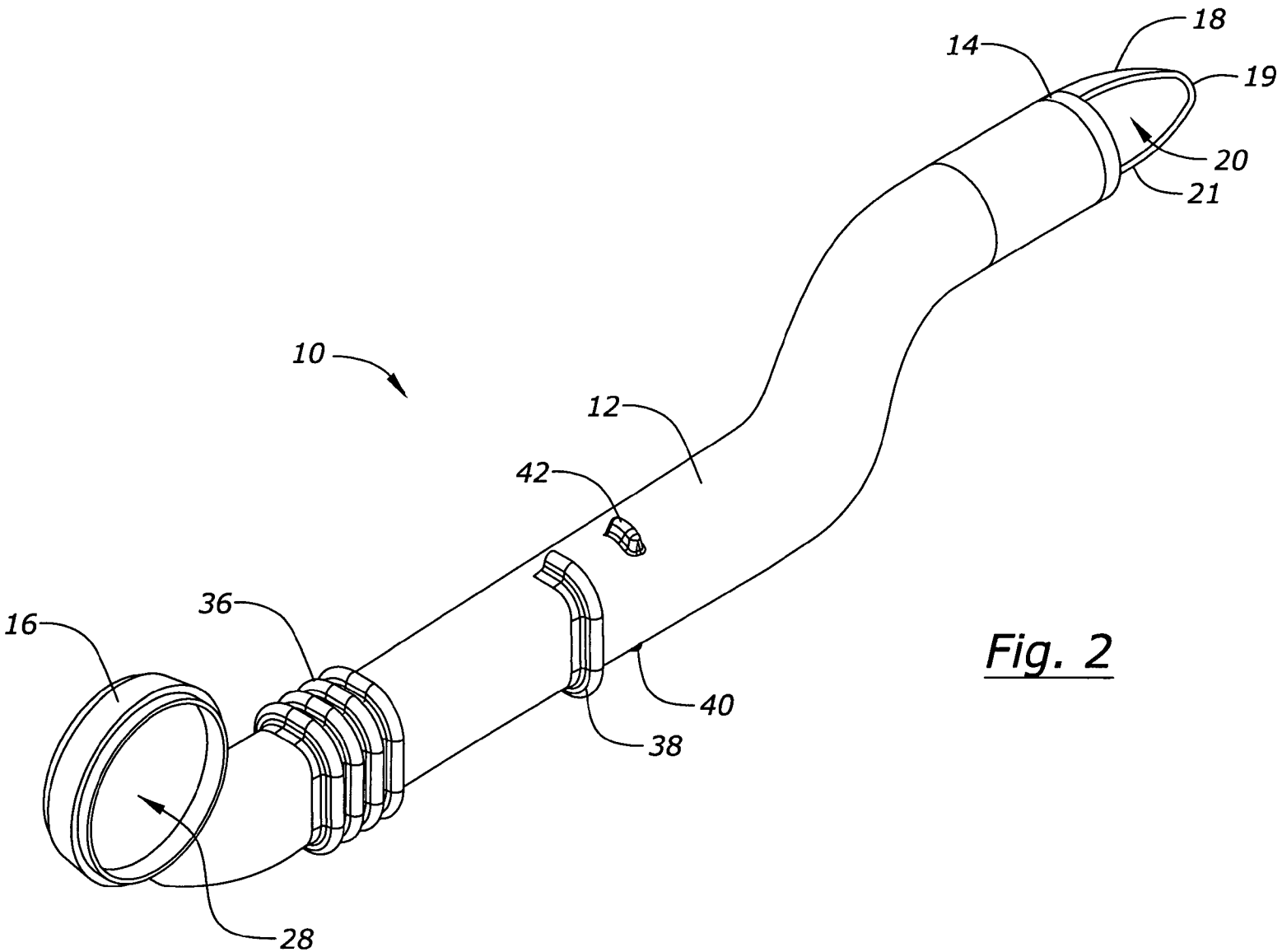
FIG. 2 is a perspective view of the wash tube showing the inlet and outlet openings of the wash tube.

The second end 16 of the wash tube 10 includes a downwardly oriented water outlet 28, as best seen in FIG. 2. The second end 16 is adapted to be coupled to a wash or spray arm 30 in any convenient manner. The coupling of the second end 16 of the wash tube 10 to the spray arm 30 allows the spray arm 30 to rotate by the force of the water sprayed from the spray arm jets or nozzles 32.

The body 12 of the wash tube 10 is adapted to be mounted or hung from the upper dishwasher rack (not shown) by means of a clip 34. The body 12 also includes a flexible bellows-type portion to provide flexibility to the body 12 and enhance docking with the manifold 24. Alignment tabs 38, 40 are shown on the body 12 and generally are provided to facilitate the manufacturing process for the wash tube 10. The body 12 is curved along its central portion to accommodate a step down area in the upper rack for holding larger objects.

The invention has been shown and described above with the preferred embodiments, and it is understood that many modifications, substitutions, and additions may be made which are within the intended spirit and scope of the invention. From the foregoing, it can be seen that the present invention accomplishes at least all of its stated objectives.

What is claimed is:

1. A wash tube for a dishwasher having a wash chamber, a rack movable between an extended loading position substantially out of the washer chamber and a retracted washing position within the wash chamber, a water manifold in a rear wall of the wash chamber, and a spray arm for spraying water onto objects to be cleaned, the wash tube comprising:

an elongated body having a first end adapted to releasably dock with the manifold at approximately a 90° angle and a second end adapted to be mounted to the spray arm; and a cap connected to the first end and having a horizontally disposed U-shaped perimeter edge defining a water inlet to redirect water flow approximately 90° from the manifold to the body.

2. The wash tube of claim 1 wherein the cap is tapered to facilitate docking of the wash tube into the manifold.

3. The wash tube of claim 1 wherein the inlet opening of the cap is downwardly facing.

4. The wash tube of claim 1 wherein the cap has a curved inner surface to capture water and to reduce the velocity of water flow at the first end of the body and to increase the pressure of water in the body.

5. The wash tube of claim 1 wherein the cap extends substantially through the manifold.

6. The wash tube of claim 1 wherein the body includes a flexible portion to facilitate docking.

7. The wash tube of claim 1 wherein the body includes bellows for flexibility.

8. The wash tube of claim 1 wherein the body is curved along its length.

9. The wash tube of claim 1 wherein the first end of the body is round, and the cap has a semi-circular end mating with an upper portion of the first end.

10. A wash tube for a dishwasher having a wash chamber, a rack movable between an extended loading position substantially out of the washer chamber and a retracted washing position within the wash chamber, a water manifold in a rear wall of the wash chamber, and a spray arm for spraying water onto objects to be cleaned, the wash tube comprising:

an elongated body having a first end adapted to releasably dock with the manifold and a second end adapted to be mounted to the spray arm; and a cap on the first end and having a concave inner surface and a downwardly directed inlet opening so that the inner surface captures water from the manifold and redirects the water into the body of the wash tube.

11. The wash tube of claim 10 wherein the cap is adapted to engage a back inner surface of the manifold without restricting water flow into the inlet opening of the first end.

12. The wash tube of claim 10 wherein the cap reduces water velocity and increases water pressure in the body.

13. The wash tube of claim 10 wherein the body includes a flexible portion to facilitate docking.

14. The wash tube of claim 10 wherein the body includes bellows for flexibility.

15. The wash tube of claim 10 wherein the second end of the tube includes a downwardly directed outlet opening for directing water into the wash arm.

16. The wash tube of claim 10 wherein the cap has a horizontally disposed, U-shaped perimeter edge defining the inlet opening.

17. The wash tube of claim 10 wherein the first end of the body is round, and the cap has a semi-circular end mating with an upper portion of the first end.

18. The wash tube of claim 10 wherein the body extends approximately 90° from the manifold and the cap redirects the flow of water approximately 90° from the manifold to the body.

* * * * *